US006829896B2

(12) United States Patent
Bruck et al.

(10) Patent No.: US 6,829,896 B2
(45) Date of Patent: Dec. 14, 2004

(54) CATALYTIC OXIDATION MODULE FOR A GAS TURBINE ENGINE

(75) Inventors: Gerald J. Bruck, Murrysville, PA (US); William E. Kepes, Trafford, PA (US); Dennis M. Bachovchin, Delmont, PA (US); Thomas E. Lippert, Murrysville, PA (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 40 days.

(21) Appl. No.: 10/319,006

(22) Filed: Dec. 13, 2002

(65) Prior Publication Data

US 2004/0112057 A1 Jun. 17, 2004

(51) Int. Cl.[7] ..... F23R 3/40; F23D 14/18

(52) U.S. Cl. ..... 60/723; 60/737; 431/170

(58) Field of Search ..... 60/777, 723, 737; 431/7, 170

(56) References Cited

U.S. PATENT DOCUMENTS

| | | | | |
|---|---|---|---|---|
| 3,938,326 A | | 2/1976 | DeCorso et al. | |
| 3,943,705 A | | 3/1976 | DeCorso et al. | |
| 4,112,675 A | | 9/1978 | Pillsbury et al. | |
| 4,845,952 A | | 7/1989 | Beebe | |
| 4,870,824 A | | 10/1989 | Young et al. | |
| 5,186,906 A | * | 2/1993 | Kawakami et al. | 422/180 |
| 5,228,847 A | * | 7/1993 | Lywood et al. | 431/7 |
| 5,461,864 A | * | 10/1995 | Betta et al. | 60/723 |
| 5,623,819 A | * | 4/1997 | Bowker et al. | 60/723 |
| 5,946,917 A | * | 9/1999 | Hums et al. | 60/723 |
| 6,174,159 B1 | | 1/2001 | Smith et al. | |
| 6,358,040 B1 | | 3/2002 | Pfefferle et al. | |
| 6,415,608 B1 | * | 7/2002 | Newburry | 60/723 |
| 2001/0046650 A1 | | 11/2001 | Smith et al. | |
| 2002/0155403 A1 | * | 10/2002 | Griffin et al. | 431/7 |
| 2002/0182551 A1 | | 12/2002 | Carroni et al. | |
| 2003/0192319 A1 | * | 10/2003 | Sprouse et al. | 60/723 |

FOREIGN PATENT DOCUMENTS

| | | | |
|---|---|---|---|
| WO | WO 93-25852 | * | 12/1993 |
| WO | WO 02/092212 A2 | | 11/2002 |

* cited by examiner

*Primary Examiner*—Ted Kim

(57) ABSTRACT

A gas turbine engine (10) includes a catalytic oxidation module (28). The catalytic oxidation module includes a pressure boundary element (30); a catalytic surface (32); and an opening (34) in the pressure boundary element to allow premixing of the fluids before the fluids enter a downstream plenum. In an embodiment, the pressure boundary element includes a catalyst-coated tube (58) having holes (68) formed therein to allow mixing across the tube. In another embodiment, the pressure boundary element includes a tubesheet (44) having a first fluid passageway intersecting a second fluid passageway to premix the fluids upstream of the outlet end of the tubesheet. In yet another embodiment, the catalytic oxidation module includes an upstream tubesheet (86) for mounting a tube inlet end (73) and a downstream tubesheet (78) for mounting a tube outlet end (72) so that the tube is slidably contained there between.

33 Claims, 3 Drawing Sheets

CATALYTIC OXIDATION MODULE FOR A GAS TURBINE ENGINE

FIELD OF THE INVENTION

This invention relates to a catalytic oxidation module for a gas turbine engine, and in particular, to a catalytic oxidation tube array module.

BACKGROUND OF THE INVENTION

Catalytic combustion systems are well known in gas turbine applications to reduce the creation of pollutants in the combustion process. As known, gas turbines include a compressor for compressing air, a combustion stage for producing a hot gas by burning fuel in the presence of the compressed air produced by the compressor, and a turbine for expanding the hot gas to extract shaft power. Diffusion flames burning at or near stoichiometric conditions with flame temperatures exceeding 3,000° F. dominate the combustion process in many older gas turbine engines. Such combustion will produce a high level of oxides of nitrogen (NOx). Current emissions regulations have greatly reduced the allowable levels of NOx emissions. One technique for reducing NOx emissions is to reduce the combustion temperature to prevent the formation of NO and $NO_2$ gases. One method for reducing combustion temperatures is to provide a lean, premixed fuel to the combustion stage. In a premixed combustion process, fuel and air are premixed in a premixing section of the combustor. The fuel-air mixture is then introduced into a combustion stage where it is burned. Another method for reducing the combustion temperature is to partially oxidize a fuel-air mixture in the presence of a catalytic agent before the fuel-air mixture passes to the combustion stage. In typical catalytic oxidation systems, a cooling means is also provided to control the temperature within the catalytic portion of the system to avoid temperature-induced failure of the catalyst and support structure materials. Cooling in such catalytic oxidation systems can be accomplished by a number of means, including passing a cooling agent over a backside of a catalyst-coated material.

U.S. Pat. No. 6,174,159 describes a catalytic oxidation method and apparatus for a gas turbine utilizing a backside cooled design. Multiple cooling conduits, such as tubes, are coated on the outside diameter with a catalytic material and are supported in a catalytic reactor. A portion of a fuel/oxidant mixture is passed over the catalyst coated cooling conduits and is oxidized, while simultaneously, a portion of the fuel/oxidant enters the multiple cooling conduits and cools the catalyst. The exothermally catalyzed fluid then exits the catalytic oxidation system and is mixed with the cooling fluid outside the system, creating a heated, combustible mixture.

To stabilize combustion of the mixture once the fluids have exited the catalytic oxidation system, it is important that flammabllity, such as flame-holding or premature auto-ignition, are minimized during mixing of the fluids. For example, premature auto-ignition can be prevented by completing the mixing process in a time that is less than the time for auto-ignition. Thus, both mixing time and auto-ignition delay time must be considered as the exothermally catalyzed fluid and the cooling fluid are mixed upon exiting the catalytic oxidation system. Accordingly, the exit portions of catalytic combustion systems have been configured to facilitate mixing of the combustion fluids in a combustion stage after the fluids separately exit the catalytic combustion system. For example, in a catalytic oxidizer module consisting of a number of catalyst coated cooling tubes, flow dynamics and mixing of fluids upon exiting the catalytic combustion system may be enhanced by providing flared tube ends at the downstream exit of the module. In addition, the flared tube ends may be closely packed to provide support for the tubes within the module to provide vibration control.

However, flaring of the tuba ends has many drawbacks. Flaring reduces the wall thickness of the tube in the area of the flare, which may lead to localized premature failure. Flaring of the tube ends also strains the tube material, which may cause cracking or embrittlement in the area of the flare. In a closely packed flared tube end configuration, the tubes are subject to wear (e.g. fretting or fret corrosion) where the flared ends abut. Furthermore, a closely packed flared tube end configuration provides no self-containment of the tubes other than the adjacent tube end points of contact. Yet another problem with a flared end tube configuration is that the exit end of the configuration presents flat surfaces that may provide a mechanism for flame attachment, resulting in premature flammability.

SUMMARY OF THE INVENTION

A catalytic oxidation module for a gas turbine engine is described herein as including: a pressure boundary element having an inlet end and an outlet end in fluid communication with a downstream plenum, the pressure boundary element separating a first fluid flow of a combustion mixture from a second fluid flow; a catalytic surface exposed to the first fluid flow between the inlet end and the outlet end; and an opening in the pressure boundary allowing fluid communication between the first and second fluid flows upstream of the outlet end. The pressure boundary element may be a tube, and the opening may be formed in the tube. The pressure boundary element may further include a tubesheet with the opening being formed in the tubesheet.

A gas turbine engine is described herein as including: a compressor for supplying a first and second fluid flow of compressed air; a fuel supply for injecting a combustible fuel into the first fluid flow; a catalytic oxidation module for at least partially combusting the combustible fuel in the first fluid flow and providing at least partial mixing of the first and second fluid flows; a combustion completion chamber receiving the first and second fluid flows from the catalytic oxidation module and producing a hot gas; and a turbine for receiving the hot gas from the combustion completion chamber. The catalytic oxidation module of the gas turbine may further include: a pressure boundary element having an inlet end and having an outlet end in fluid communication with the combustion completion chamber, the pressure boundary element separating the first and second fluid flows along a portion of its length; a catalytic surface exposed to the first fluid flow between the inlet and outlet ends; and an opening in the pressure boundary element allowing fluid communication between the first and second fluid flows upstream of the outlet end.

BRIEF DESCRIPTION OF THE DRAWINGS

These and other advantages of the invention will be more apparent from the following description in view of the drawings that show.

DETAILED DESCRIPTION OF THE INVENTION

Figure 1:
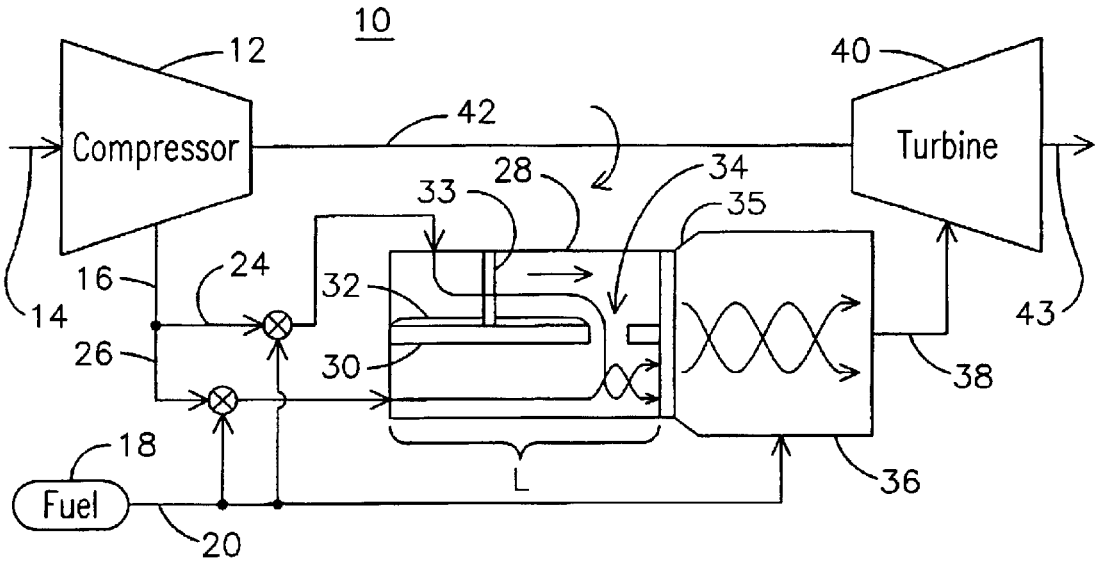
FIG. 1 is a functional diagram of a gas turbine engine utilizing a catalytic oxidation module.

FIG. 1 illustrates a gas turbine engine 10 having a compressor 12 for receiving a flow of filtered ambient air 14 and for producing a flow of compressed air 16. The compressed air 16 is separated into a combustion mixture fluid flow 24 and a cooling fluid flow 26, respectively, for introduction into a catalytic oxidation module 28. The combustion mixture fluid flow 24 is mixed with a flow of a combustible fuel 20, such as natural gas or fuel oil for example, provided by a fuel source 18, prior to introduction into the catalytic oxidation module 28. The cooling fluid flow 26 may be introduced directly into the catalytic oxidation module 28 without mixing with a combustible fuel. Optionally, the cooling fluid flow 26 may be mixed with a flow of combustible fuel 20 before being directed into the catalytic oxidation module 28.

Inside the catalytic oxidation module 28, the combustion mixture fluid flow 24 and the cooling fluid flow 26 are separated, for at least a portion of the travel length, L, by a pressure boundary element 30. In an aspect of the invention, the pressure boundary element 30 is coated with a catalyst 32 on the side exposed to the combustion mixture fluid flow 24. The catalyst 32 may have as an active ingredient of precious metals, Group VIII noble metals, base metals, metal oxides, or any combination thereof. Elements such as zirconium, vanadium, chromium, manganese, copper, platinum, palladium, osmium, iridium, rhodium, cerium, lanthanum, other elements of the lanthanide series, cobalt, nickel, iron, and the like may be used.

In a backside cooling embodiment, the opposite side of the pressure boundary element 30 confines the cooling fluid flow 26 for at least a portion of the travel length, L. While exposed to the catalyst 32, the combustion mixture fluid flow 24 is oxidized in an exothermic reaction, and the catalyst 32 and the pressure boundary element 30 are cooled by the unreacted cooling fluid flow 26, thereby absorbing a portion of the heat produced by the exothermic reaction.

The pressure boundary element 30 may include a tube for containing a fluid flow. The tube may be coated on its outside diameter surface with a catalyst 32 to be exposed to a combustion mixture fluid flow 24 traveling around the exterior of the tube. In a backside cooling arrangement, the cooling fluid flow 26 is directed to travel through the interior of the tube. Alternatively, the tubes may be coated on the interior with a catalyst 32 to expose a combustion mixture fluid flow 24 traveling through the interior of the tube, while the cooling fluid flow 26 travels around the exterior of the tube. Other methods may be used to expose the combustion mixture fluid flow 24 to a catalyst 32, such as constructing a structure to suspend the catalyst in the combustion mixture fluid flow 24, constructing a structure from a catalytic material to suspend in the combustion mixture fluid flow 24, or providing pellets coated with a catalyst material exposed to the combustion mixture fluid flow 24.

In one embodiment, an opening 34 is provided in the pressure boundary element 30 to allow passage of one of the flows 24, 26 into the other flow 24, 26 to promote premixing of the combustion mixture fluid flow 24 and the cooling fluid flow 26. For example, as shown in FIG. 1, the combustion mixture fluid flow 24 may be allowed to pass through the opening 34, such as a perforation, in the pressure boundary element 30 to premix with the cooling fluid flow 26 before the cooling fluid flow 26 exits the catalytic oxidation module 28. The direction of flow through the opening may be controlled by adjusting the relative pressures between the combustion mixture fluid flow 24 and the cooling fluid flow 26. In an embodiment, a baffle 33 may be disposed in one or both of the flows 24,26 to ensure that the flow is evenly distributed throughout the catalytic oxidation module 28. By allowing premixing of the flows 24,26 prior to the flows 24,26 exiting the catalytic oxidation module 28, improved flammability control can be obtained and a lower peak combustion operation temperature can be supported. In another aspect of the invention, a pressure boundary element retainer 35, such as a tubesheet, may be provided at the exit of the catalytic oxidation module 28. The retainer 35 may form part of the pressure boundary element 30 and the retainer 35 may be formed to further promote the mixing of the flows 24,26, as will be described more fully below.

After the flows 24,26 exit the catalytic oxidation module 28, the flows 24,26 are mixed and combusted in a plenum, or combustion completion stage 36, to produce a hot combustion gas 38. In one aspect of the invention, the flow of a combustible fuel 20 is provided to the combustion completion stage 36 by the fuel source 18. The hot combustion gas 38 is received by a turbine 40, where it is expanded to extract mechanical shaft power. In one embodiment, a common shaft 42 interconnects the turbine 40 with the compressor 12 as well as an electrical generator (not shown) to provide mechanical power for compressing the ambient air 14 and for producing electrical power, respectively. The expanded combustion gas 43 may be exhausted directly to the atmosphere or it may be routed through additional heat recovery systems (not shown).

The catalytic oxidation module 28 provides improved performance as a result of the premixing features that are shown more clearly in FIGS. 2–5. FIGS. 2A–2C illustrate an embodiment where premixing occurs within a downstream end tubesheet. FIG. 2A is a partial plan view of a tubesheet 44 in a catalytic oxidation module 28. FIG. 2A illustrates a section of the tubesheet 44 (shown from an outlet side) taken perpendicular to the direction of flows 24,26 through the catalytic oxidation module 28. The pressure boundary element 30 includes the tubesheet 44. The tubesheet 44 provides premixing of the flows 24,26 before the flows 24,26 exit the catalytic oxidation module 28. The tubesheet 44 includes cooling fluid flow passageways 46 and combustion mixture fluid flow passageways 48 that intersect within the confines of the tubesheet 44 to promote premixing as the fluid pass through the tubesheet 44.

Figure 2A:
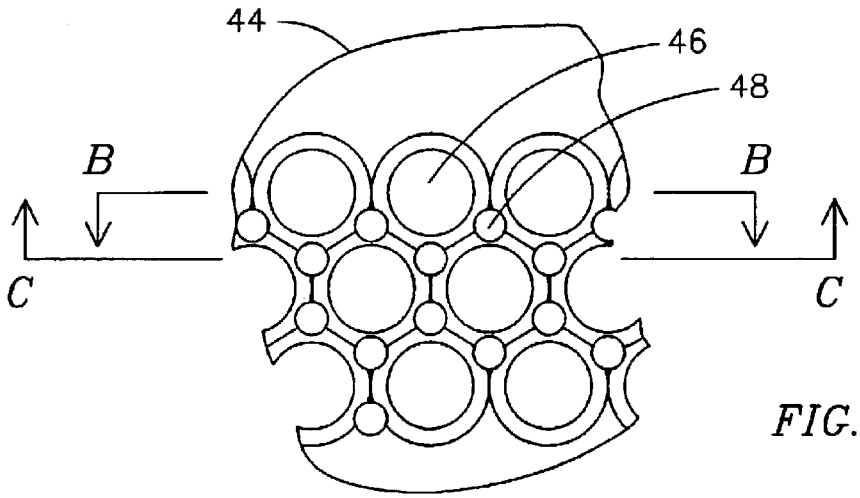
FIG. 2A is a partial plan view of a tubesheet of a catalytic oxidation module.
Figure 2B:
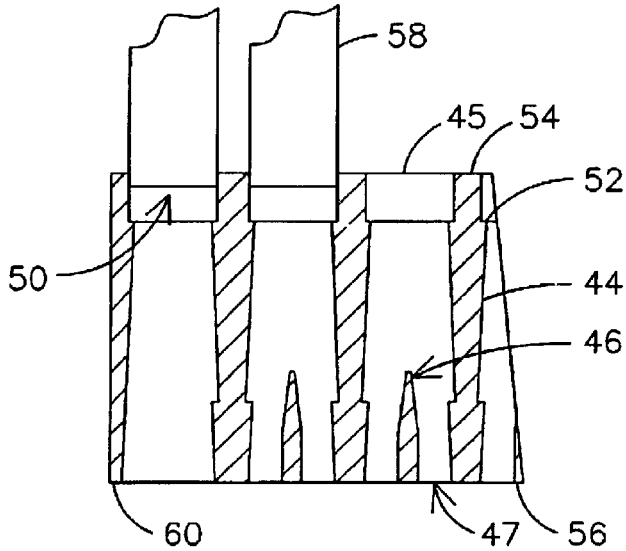
FIG. 2B is a partial sectional view of the tubesheet of FIG. 2A indicated by the section arrows labeled "B—B" in FIG. 2A, showing aspects of the interior thereof.

FIG. 2B is a partial sectional view of the tubesheet section of FIG. 2A indicated by the section arrows labeled "B—B."

FIG. 2B illustrates a section taken parallel to the direction of flows 24,26 through the catalytic oxidation module 28. As shown in FIG. 2B, the tubesheet 44 includes cooling fluid flow passageways 46 extending from a respective cooling fluid flow passageway inlet opening 45 on the tubesheet inlet side 54 to a cooling fluid flow passageways outlet opening 47 on the tubesheet outlet side 56. Each cooling fluid flow passageway 46 includes a counterbore 50, terminating in a shoulder 52, in the tubesheet inlet side 54 of the tubesheet 44. Each of the tubes 58 is partially extended (such as 0.1 inch) into the counterbore 50, leaving room (for example, 0.07 inch) for axial differential thermal expansion of the respective installed tube 58. The shoulder 52 can be configured to have an inner diameter smaller than the outside diameter of the tube 58 to contain the tube axially if the tube becomes dislodged at an upstream point of fixture. In another aspect of the invention, the cooling fluid flow passageway 46 further flares from a smaller diameter (such as 0.168 inch) at the shoulder 52 of the counterbore 50 to a larger diameter (for example, 0.244 inch) at the tubesheet outlet side 56. The flare may be configured to enhance mixing at the tubesheet outlet side 56. For example, the flare may slope at an eight-degree included angle.

In contrast to flared tube ends, a tube sheet 44 having tapered openings provides improved geometric consistency and material integrity to improve premixing and provide longer tube service intervals. Advantageously, the edges 60 at tubesheet outlet side 56 can be configured to have sharp terminations with a small downstream surface area to enhance premixing and to minimize flame-holding at the exit of the catalytic oxidation module 28.

Figure 2C:
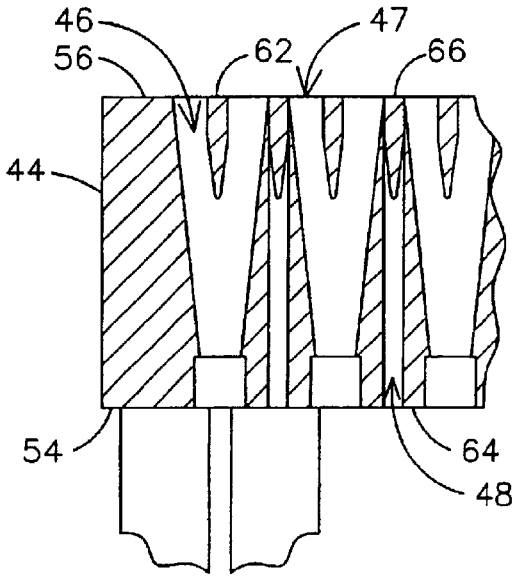
FIG. 2C is a partial sectional view of the tubesheet of FIG. 2A indicated by the section arrows labeled "C—C" in FIG. 2A, showing aspects of the interior thereof.

FIG. 2C is a partial sectional view of the tubesheet section of FIG. 2A indicated by the section arrows labeled "C—C." FIG. 20 illustrates a section taken parallel to the direction of flows 24,26 through the catalytic oxidation module 28, and includes a longitudinal view of combustion mixture fluid flow passageways 48. As shown in FIG. 20, the tube sheet 44 includes combustion mixture fluid flow passageways 48 extending from the tubesheet inlet side 54 at a combustion mixture fluid flow passageway inlet opening 64 to the tubesheet outlet side 56. The combustion mixture fluid flow passageway inlet openings 64 do not intersect the cooling fluid flow passageways inlet openings 46 on the tubesheet inlet side 64. Notably, however, the combustion mixture fluid flow passageway outlet openings 68 partially intersect 62 the cooling fluid flow passageways 46 near the tubesheet outlet side 56, thereby promoting premixing of the flows 24,26 exiting the catalytic oxidation module 28. In a further aspect of the invention, each combustion mixture fluid flow passageway 48 can be tapered from a larger diameter (selected to fit between the counterbores 50 at the tubesheet inlet side 54) to a smaller diameter at the tubesheet outlet side 56, so that the combustion mixture fluid flow passageways 48 partially intersect 62 the cooling fluid flow passageways 46. Accordingly, fluids flowing through the combustion mixture fluid flow passageway 48 can be partially premixed with fluids flowing in the cooling fluid flow passageways 46, for example, to provide improved flammability control in the combustion completion stage 36.

Figure 3:
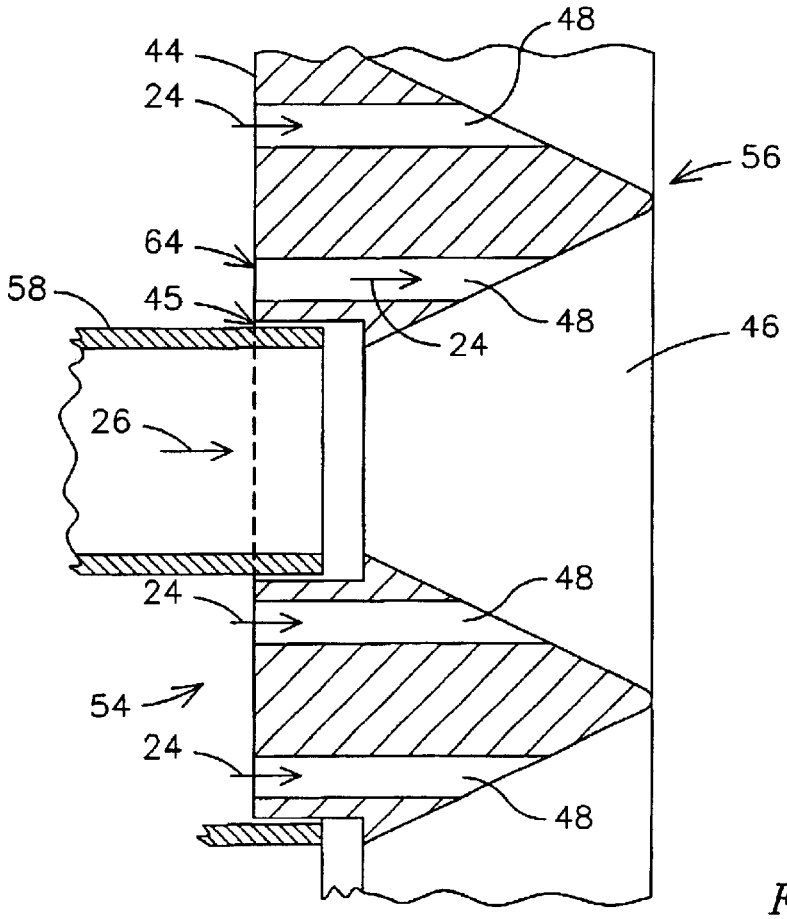
FIG. 3 is a partial cut away view of an embodiment of a tubesheet of the catalytic oxidation module of FIG. 1, showing aspects of the interior thereof.

FIG. 3 is a partial cut away view of an embodiment of a tubesheet of the catalytic oxidizer system of FIG. 1, showing aspects of the interior thereof. FIG. 3 illustrates a cut away section taken parallel to the direction of flows 24,26 through the catalytic oxidation module 28. As shown in FIG. 3, the tube sheet 44 includes cooling fluid flow passageways 46 having tubes 58 extended therein. The cooling fluid flow passageways 46 are flared to have an increasing diameter in a downstream direction. In addition, the tubesheet 44 may include combustion mixture fluid flow passageways 48 extending from the tubesheet inlet side 54 and configured to intersect the cooling fluid flow passageway 46 near the tubesheet outlet side 56. The size, placement, and number of combustion mixture fluid flow passageways 48 may be selected to achieve a desired premixing of flows 24,26. The combustion mixture fluid flow passageways 48 do not completely penetrate the tubesheet 44, allowing more of the mass of the tubesheet 44 around the cooling fluid flow passageways 46 to be preserved, to at least partially compensate for the loss of strength caused by the flaring of the cooling fluid flow passageway 46. As a result, the tubesheet 44 retains structural integrity and provides greater resistance to oxidation and deterioration in service.

Figure 4:
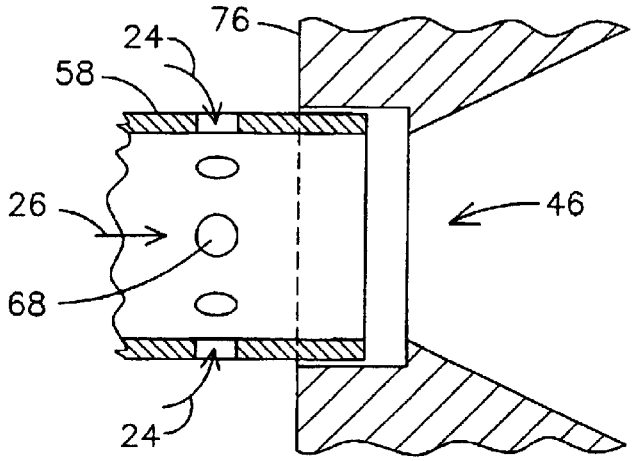
FIG. 4 is a partial cut away view of an embodiment of a tubesheet of the catalytic oxidation module of FIG. 1, showing aspects of a tube extended therein.

FIG. 4 is a partial cut away view of an embodiment of a tubesheet of the catalytic oxidizer system of FIG. 1, showing aspects of a tube extended therein. FIG. 4 illustrates a section taken parallel to the direction of flows 24,26 through the catalytic oxidation module 28. As shown in FIG. 4, the tubesheet 76 includes cooling fluid flow passageways 46 having tubes 58 extended therein. Premixing of fluids 24, 26 is provided by openings such as holes 68 in the tube 58. Accordingly, in an aspect of the invention, each tube 58 includes openings formed near the outlet end of the tube 58 to allow passage of the combustion mixture fluid flow 24 into the cooling fluid flow 26 flowing in the tube 58. As a result, the fluids 24, 26 can be premixed before entering the combustion completion stage 36. In an embodiment, the openings include a series of annular holes 68 formed in the tube 58. The size, number and placement of holes 68 may be selected to achieve a desired premixing of flows 24,26. Importantly, premixing can be adjusted in predetermined areas of the catalytic oxidation module 28, such as the outer perimeter of the tubesheet 44, by adjusting the placement and size of holes 68 to achieve a uniform or otherwise selected degree of premixing. Accordingly, it should be understood that the hole 68 configuration is not limited to an annular format, and the holes 68 could be sized and positioned along the length of the tube 58 in a desired configuration to achieve a specific premixing pattern.

Figure 5:
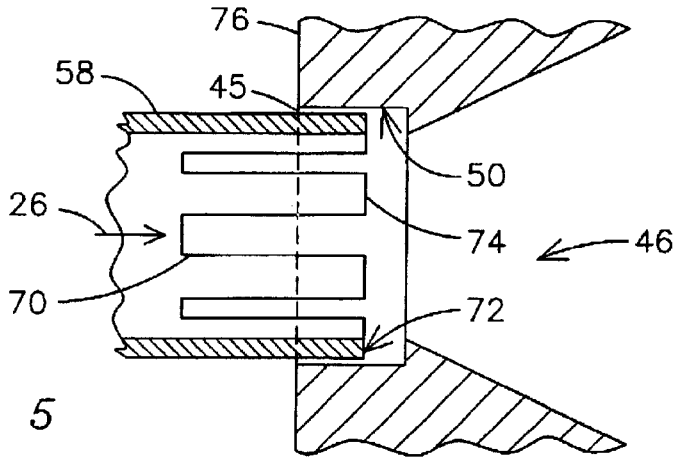
FIG. 5 is a partial cut away view of an embodiment of a tubesheet of the catalytic oxidation module of FIG. 1, showing aspects of a tube extended therein.

FIG. 5 is a partial cut away view of an embodiment of a tubesheet 76 of the catalytic oxidizer system of FIG. 1, showing aspects of a tube 58 extended therein. In the embodiment depicted, openings formed near a tube outlet end 72 include a series of annular slots 70 to allow passage of the combustion mixture fluid flow 24 into the cooling fluid flow 26 flowing in the tube 58. In an aspect of the invention, the slots 70 are positioned so that the downstream end of each slot 70 corresponds with the tube outlet end 72 to form lingers 74 at the tube outlet end 72. The slots 70 are configured to allow passage of the combustion mixture fluid flow 24 into the cooling fluid flow 26 flowing in the tube 58 when the tube 58 is installed into the cooling fluid flow passageway 46 formed in the tubesheet 76. In an embodiment, the fingers 74 can be biased radially away from the tube centerline to provide a biased engagement against the walls of the counterbore 50 when the tube 58 is extended into the respective cooling fluid flow passageway inlet opening 45. The biased engagement of the fingers 74 against the walls of the counterbore 50 can be particularly effective for damping potential vibrations. Advantageously, the size, placement, and number of slots 70 may be selected to achieve a desired premixing of flows 24,26.

Figure 6:
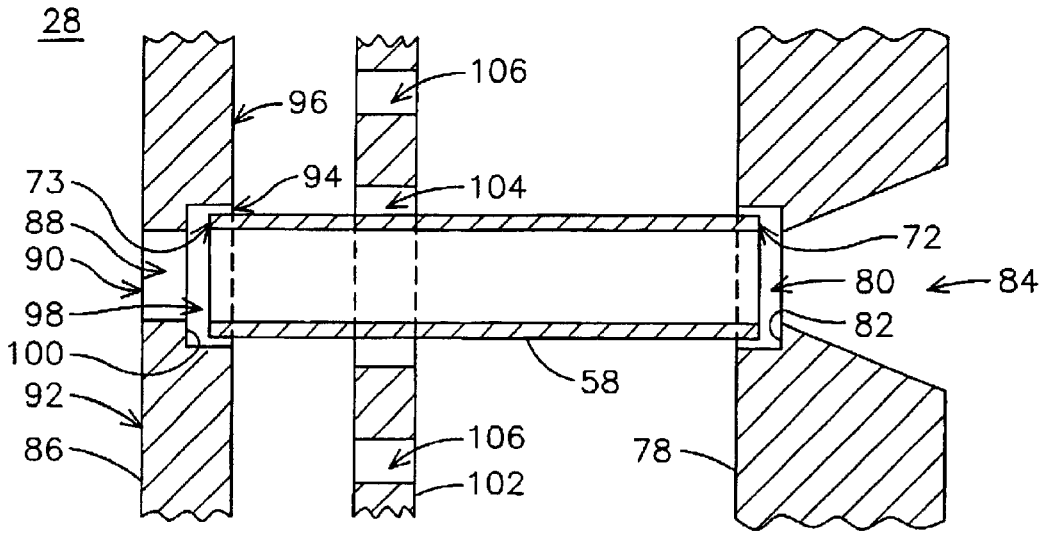
FIG. 6 is a partial cut away view of an embodiment of a catalytic oxidation module of the gas turbine engine of FIG. 1 showing a tube axially contained by an upstream tubesheet and a downstream tubesheet.

FIG. 6 is a partial cut away view of an embodiment of a catalytic oxidation module 28 of the catalytic oxidizer system of FIG. 1, showing a tube 58 axially contained by an upstream tubesheet 86 and a downstream tubesheet 78. FIG. 6 illustrates a cut away section taken parallel to the direction of flow through the catalytic oxidation module 28. As shown in FIG. 6, the downstream tubesheet 78 (as described previously with respect to FIGS. 2A, 2B, 2C and 3), includes a counterbore 80, terminating in a shoulder 82, to contain the tube 58 at a tube outlet end 72 and prevent the tube 58 from axially passing further through a downstream tubesheet fluid flow passageway 84. An inlet end 73 of the tube 58 is similarly mounted in the upstream tubesheet 86 so that the tube 58 is supported at both ends 72, 73 within the catalytic oxidation module 28. The upstream tubesheet 86 includes an upstream tubesheet fluid flow passageway 88 extending from a respective upstream tubesheet fluid flow passageway inlet opening 90 on an upstream tubesheet inlet side 92, to an upstream tubesheet fluid flow passageway outlet opening 94 on an upstream tubesheet outlet side 96. In an aspect of the invention, the upstream tubesheet fluid flow passageway 88 includes a counterbore 98, terminating in a shoulder 100, in the upstream tubesheet outlet side 96 of the tubesheet 86. The tube inlet end 73 of the tube 58 is partially extended (such as 0.1 inch) into the counterbore 98, leaving room (for example, 0.07 inch) for axial differential thermal expansion of the respective installed tube 58. The shoulder 100 can be configured to have a smaller inner diameter less than the outside diameter of the tube 58 to contain the tube 58 axially, for example, if the tube 58 becomes dislodged downstream. In an aspect of the invention, the downstream tubesheet 78 and the upstream tubesheet 86 allow the tube 58, mounted in the respective counterbores 80, 98, to slidably move within each counterbore 80, 98 (such as with axial thermal expansion of the tube 58) while preventing the tube 58 from becoming dislodged from the upstream tubesheet 86 and downstream tubesheet 78. Advantageously, the tubes 58 contained in the catalytic oxidation module 28 in the above-described manner are easily removable for servicing or replacement.

In a further aspect of the invention, a baffle 102 may be placed within the catalytic oxidation module 28 between the upstream tubesheet 86 and downstream tubesheet 78, for example, to distribute fluid flows evenly through the catalytic oxidation module 28. The baffle 102 includes a tube passageway 104 extending through the baffle 102 to allow the tube 58 to pass through the baffle 102. The tube passageway 104 diameter can be configured to have a larger diameter than the outside diameter of the tube 58 so that the tube 58 is not constricted when passed through the tube passageway 104. In a further aspect, the tube passageway 104 can be made large enough to permit fluid flow around the tube 58 positioned in the tube passageway 104. In another aspect of the invention, the baffle 102 includes baffle fluid flow passageways 106, positioned and sized to regulate fluid flow through the catalytic oxidation module 28 in a desired manner.

In yet another aspect of the invention, the structural elements described herein, such as the tubes and tubesheets, are formed from corrosion, high temperature, and wear resistant materials to prolong the life of the elements in the catalytic oxidation module 28. For example, the components of the catalytic oxidation module 28 can be made of corrosion and wear resistant alloys such as the cobalt alloys Ultimet™ 188, and L605, available from Haynes International Corporation, to extend the serviceable life of the elements.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A catalytic oxidation module for a gas turbine engine comprising:

a pressure boundary element, comprising a tube and a downstream tubesheet comprising a first opening receiving the tube, the pressure boundary element having an inlet end and an outlet end in fluid communication with a downstream plenum, the pressure boundary element separating a first fluid flow of a combustion mixture from a second fluid flow;

a catalytic surface exposed to the first fluid flow between the inlet end and the outlet end; and a second opening in the tubesheet having an inlet end remote from the first opening and having an outlet end in fluid communication with the first opening to allow mixing of the first fluid flow and the second fluid flow within the tubesheet upstream of the outlet end of the pressure boundary element.

2. The catalytic oxidation module of claim 1, wherein the second fluid flow comprises a cooling fluid containing no combustible fuel.

3. The catalytic oxidation module of claim 1, wherein the catalytic surface comprises a surface of the pressure boundary element.

4. The catalytic oxidation module of claim 1, further comprising a third opening is formed in the tube.

5. The catalytic oxidation module of claim 4, wherein the third opening comprises a plurality of holes formed in the tube.

6. The catalytic oxidation module of claim 4, wherein the third opening comprises a plurality of slots formed in the tube.

7. The catalytic oxidation module of claim 6, wherein the slots are formed in the outlet end to form annular fingers.

8. The catalytic oxidation module of claim 1, the tubesheet further comprising a passageway for receiving the tube, the passageway having a first diameter at an inlet side and a second diameter larger than the first diameter at an outlet side.

9. The catalytic oxidation module of claim 8, wherein the tube is slidably engaged within the tubesheet passageway to facilitate axial expansion and contraction of the tube.

10. The catalytic oxidation module of claim 9, wherein the passageway comprises a counterbore on the inlet side terminating in a shoulder.

11. The catalytic oxidation module of claim 1, further comprising an upstream tubesheet connected to the inlet end of the tube, the upstream tubesheet comprising an upstream tubesheet passageway for receiving the tube, the upstream tubesheet passageway comprising a counterbore terminating in a shoulder for receiving the tube, wherein the tube is slidably engaged within the counterbore to facilitate axial expansion and contraction of the tube.

12. The catalytic oxidation module of claim 1, the downstream tubesheet further comprising a first fluid passageway comprising a first fluid inlet opening receiving the first fluid flow and a first fluid outlet opening, the downstream tubesheet further comprising a second fluid passageway receiving the outlet end of the tube and directing the second fluid flow to a downstream plenum, the first fluid passageway intersecting the second fluid passageway upstream of the downstream plenum.

13. The catalytic oxidation module of claim 12, wherein the second fluid passageway flares from a smaller diameter proximate a tubesheet inlet side to a larger diameter proximate a downstream tubesheet outlet side.

14. The catalytic oxidation module of claim 13, wherein the downstream tubesheet outlet side is configured to have a surface area effective to minimize flameholding points.

15. The catalytic oxidation module of claim 12, wherein the tube is slidable within the second fluid passageway to accommodate axial expansion and contraction of the tube.

16. The catalytic oxidation module of claim 15, wherein the second fluid passageway comprises a counterbore terminating in a shoulder for receiving the tube.

17. The catalytic oxidation module of claim 1, further comprising an upstream tubesheet connected to the inlet end of the tube, the upstream tubesheet comprising an upstream tubesheet passageway for receiving the tube, the upstream tubesheet passageway comprising a counterbore terminating in a shoulder for receiving the tube, wherein the tube is slidably engaged within the counterbore to facilitate axial expansion and contraction of the tube.

18. The catalytic oxidation module of claim 1, further comprising a baffle disposed between the pressure boundary element inlet end and the pressure boundary element outlet end for regulating the fluid communication between the first and second fluid flows.

19. A catalytic oxidation module for a gas turbine engine comprising:

a pressure boundary element having an inlet end and an outlet end in fluid communication with a downstream plenum, the pressure boundary element separating a first fluid flow of a combustion mixture from a second fluid flow;

a catalytic surface exposed to the first fluid flow between the inlet end and the outlet end;

an opening in the pressure boundary allowing fluid communication between the first and second fluid flows upstream of the outlet end;

wherein the pressure boundary element comprises a tube;

wherein the opening comprises a plurality of slots formed in the tube;

wherein the slots are formed in the outlet end to form annular fingers; and wherein the fingers are biased radially away from a tube centerline to provide a biased engagement when the tube is extended into a corresponding opening.

20. A gas turbine engine comprising:

a compressor for supplying a first and second fluid flow of compressed air;

a fuel supply for injecting a combustible fuel into the first fluid flow;

a catalytic oxidation module for at least partially combusting the combustible fuel in the first fluid flow and providing at least partial mixing of the first and second fluid flows a combustion completion chamber receiving the first and second fluid flows from the catalytic oxidation module and producing a hot gas; and a turbine for receiving the hot gas from the combustion completion chamber;

wherein the catalytic oxidation module further comprises a pressure boundary element, comprising a tube and a downstream tubesheet comprising a first opening receiving the tube, the pressure boundary element having an inlet end and having an outlet end in fluid communication with the combustion completion chamber, the pressure boundary element separating the first and second fluid flows along a portion of its length;

a catalytic surface exposed to the first fluid flow between the inlet and outlet ends;

a second opening in the tubesheet having an inlet end remote from the first opening and having an outlet end in fluid communication with the first opening to allow mixing of the first fluid flow and the second fluid flow within the tubesheet upstream of the outlet end of the pressure boundary element.

21. The gas turbine engine of claim 20, further comprising a third opening is formed in the tube.

22. The gas turbine engine of claim 21, wherein the third opening comprises a plurality of holes formed in the tube.

23. The gas turbine engine of claim 21, wherein the third opening comprises a plurality of slots formed in the tube.

24. The gas turbine engine of claim 23, wherein the slots are formed in the outlet end to form annular fingers.

25. The gas turbine engine of claim 20, the tubesheet comprising a passageway for receiving the tube, the passageway having a first diameter at an inlet side and a second diameter larger than the first diameter at an outlet side.

26. The gas turbine engine of claim 20, further comprising an upstream tubesheet connected to the inlet end of the tube, the upstream tubesheet comprising an upstream tubesheet passageway for receiving the tube, the upstream tubesheet passageway comprising a counterbore terminating in a shoulder for receiving the tube, wherein the tube is slidably engaged within the counterbore to facilitate axial expansion and contraction of the tube.

27. The gas turbine engine of claim 20, wherein the tubesheet further comprises a first fluid passageway comprising a first fluid inlet opening receiving the first fluid flow and a first fluid outlet opening and a second fluid passageway receiving the outlet end of the tube and directing the second fluid flow to a downstream plenum, the first fluid passageway intersecting the second fluid passageway upstream of the downstream plenum.

28. The gas turbine engine of claim 27, wherein the second fluid passageway flares from a smaller diameter proximate a tubesheet inlet side to a larger diameter at an outlet side.

29. The gas turbine engine of claim 20, further comprising an upstream tubesheet connected to the inlet end of the tube, the upstream tubesheet comprising an upstream tubesheet passageway for receiving the tube, the upstream tubesheet passageway comprising a counterbore terminating in a shoulder for receiving the tube, wherein the tube is slidably engaged within the counterbore to facilitate axial expansion and contraction of the tube.

30. A gas turbine engine comprising:

a compressor for supplying a first and second fluid flow of compressed air;

a fuel supply for injecting a combustible fuel into the first fluid flow;

a catalytic oxidation module for at least partially combusting the combustible fuel in the first fluid flow and providing at least partial mixing of the first and second fluid flows;

a combustion completion chamber receiving the first and second fluid flows from the catalytic oxidation module and producing a hot gas;

a turbine for receiving the hot gas from the combustion completion chamber;

wherein the catalytic oxidation module further comprises a pressure boundary element having an inlet end and having an outlet end in fluid communication with the combustion completion chamber, the pressure boundary element separating the first and second fluid flows along a portion of its length;

a catalytic surface exposed to the first fluid flow between the inlet and outlet ends;

an opening in the pressure boundary element allowing fluid communication between the first and second fluid flows upstream of the outlet end;

wherein the pressure boundary element comprises a tube;

wherein the opening comprises a plurality of slots formed in the tube;

wherein the slots are formed in the outlet end to form annular fingers; and wherein the fingers are biased radially away from a tube centerline to provide a biased engagement when the tube is extended into a corresponding opening.

31. A catalytic oxidation module for a gas turbine engine comprising:

a plurality of tubes having inlet and outlet ends, the outlet ends inserted into a corresponding first plurality of passageways in a tubesheet;

a first fluid flow flowing within an inside diameter of the tubes and exhausted into a downstream combustion chamber through the tubesheet at the respective outlet ends;

a second fluid flow flowing among the tubes along an outside diameter of the tubes and exhausted into the downstream combustion chamber through a second plurality of passageways in the tubesheet;

an opening formed in each respective tube sized to allow partial mixing of the first and second fluid flows upstream of the tubesheet so that one of the first and second flows is split to exit through both the tubes and the second plurality of passageways wherein the opening comprises a plurality of slots in the respective outlet ends defining annular fingers biased radially away from a centerline of the respective tube to provide a biased engagement between the tube and the tubesheet when the tube is extended into a corresponding passageway; and a catalytic surface formed on either an outside diameter or an inside diameter surface of the tubes.

32. A catalytic oxidation module for a gas turbine engine comprising:

a pressure boundary element, comprising a tube and a downstream tubesheet comprising a first opening receiving the tube, the pressure boundary element having an inlet end and an outlet end in fluid communication with a downstream plenum, the pressure boundary element separating a first fluid flow of a combustion mixture from a second fluid flow;

a catalytic surface exposed to the first fluid flow between the inlet end and the outlet end;

a tubesheet connected to the outlet end of the pressure boundary element; and a second opening in the tubesheet having an inlet end remote from the first opening and having an outlet end in fluid communication with the first opening to allow mixing of the first fluid flow and the second fluid flow within the tubesheet.

33. The catalytic oxidation module of claim 32, wherein the tubesheet comprises a tapered passageway for receiving the pressure boundary element, the passageway comprising an inlet having a inlet cross sectional area and an outlet having an outlet cross sectional area larger than the inlet cross sectional area wherein the opening intersects the tapered passageway within the tubesheet.

* * * * *